US012571219B2

(12) United States Patent
VanValien, III

(10) Patent No.: US 12,571,219 B2
(45) Date of Patent: Mar. 10, 2026

(54) DRYWALL MUD PAN CONFIGURATION

(71) Applicant: William H. VanValien, III, Hubbard, OH (US)

(72) Inventor: William H. VanValien, III, Hubbard, OH (US)

( * ) Notice: Subject to any disclaimer, the term of this patent is extended or adjusted under 35 U.S.C. 154(b) by 8 days.

(21) Appl. No.: 18/594,370

(22) Filed: Mar. 4, 2024

(65) Prior Publication Data

US 2024/0209640 A1 Jun. 27, 2024

Related U.S. Application Data

(63) Continuation-in-part of application No. 17/934,363, filed on Sep. 22, 2022, now Pat. No. 12,203,278.

(51) Int. Cl.
*B65D 6/34* (2006.01)
*E04F 21/02* (2006.01)

(52) U.S. Cl.
CPC ..... *E04F 21/02* (2013.01)

(58) Field of Classification Search
CPC ..... E04F 21/02; B65D 11/26; B65D 11/28; B65D 11/22
USPC ..... 220/657, 643, 642, 640
See application file for complete search history.

(56) References Cited

U.S. PATENT DOCUMENTS

| | | | | |
|---|---|---|---|---|
| 5,634,539 | A * | 6/1997 | Gordon | A45C 5/02 217/65 |
| 6,006,936 | A | 12/1999 | Przybylowicz | |
| 6,454,124 | B1 | 9/2002 | Edwards et al. | |
| 7,621,417 | B2 * | 11/2009 | Peterson | B65D 43/0212 264/250 |
| 2006/0169705 | A1 | 8/2006 | Pool | |
| 2010/0065719 | A1 | 3/2010 | Szasz | |
| 2012/0067906 | A1 | 3/2012 | Szasz | |

* cited by examiner

*Primary Examiner* — Stephen J Castellano
(74) *Attorney, Agent, or Firm* — Haraman & Harpman

(57) ABSTRACT

A drywall mud pan that combines the shape retaining and mud dispensing properties of the traditional metal mud pan with the advantage of resilient easy to grip pan. A light-weight rigid support frame has upstanding mud tool engagement band edges. A flexible resilient mud retaining insert is supported within and interlocked by insert flange engagement between support frame spaced alignment end tabs which as assembled allows the user to comfortably grip and hold the pan by its flexible resilient insert while having the advantages of a rigid tool engagement scraping edges as found in traditional mud pans.

4 Claims, 12 Drawing Sheets

DRYWALL MUD PAN CONFIGURATION

This application is a Continuation in Part application of Ser. No. 17/934,363, filed Sep. 22, 2022.

BACKGROUND OF THE INVENTION

1. Technical Field

This invention relates to dispensing containers for temporarily holding a volume of viscous and settleable material, specifically drywall and compound mud which is applied over drywall installed surfaces.

2. Description of Prior Art

Prior art mudding pans or troughs are well known in the art for holding and allowing the dispensing of drywall mud or "joint compound" that covers seams associated with the application of drywall sheets. Such existing pans have an elongated shape with tapered interior sides and preferably a sharp edge tool engagement to aid in the manipulation and operation of compound application on a drywall.

Such examples of mud pans can be seen in U.S. Pat. Nos. 6,006,936, 6,454,124 and U.S. Publications 2006/0169705, 2010/0065719 and 2012/0067906.

In U.S. Pat. No. 6,006,936 a mud pan is disclosed having a conventionally shaped pan trough with the addition of secondary material retainment and a plurality of knife engagement trough edges.

U.S. Pat. No. 6,454,124 is directed to a mud pan for drywall compound having a bottom formed of sheet material held in shape and forming a rectangular frame.

U.S. Publication 2006/0169705 discloses a round bottom mud pan with a hand grip insert on its bottom surface defining a contoured engagement.

U.S. Publication 2010/0065719 shows a mud pan formed entirely from flexible material that can be flexed to remove dried compound from within.

In U.S. Publication 2012/0067906 a flexible drywall pan is illustrated having an insert that is supported by a rigid upper frame under a return lip on the pan.

SUMMARY OF THE INVENTION

A hybrid drywall mud pan that has a resilient flexible mud retaining body member selectively retained within self-supporting housing that allows for tool edge engagement on a metal edge and a comfortable user engagement surface with a plurality of selective engagement retainment fasteners affording a secure continuous retainment during use.

SUMMARY OF THE INVENTION

The present invention discloses a hybrid container for holding and dispensing composition mud material for drywall finishing. The container has a self-supporting frame portion for a selectively attachable resilient flexible material retainment trough insert. A pair of mud tool engagement edge elements are alternately retained within the support frames having pairs of friction fit trough receiving fittings for receiving and retaining the flexible trough insert there within.

DETAILED DESCRIPTION OF THE INVENTION

Figure 1:
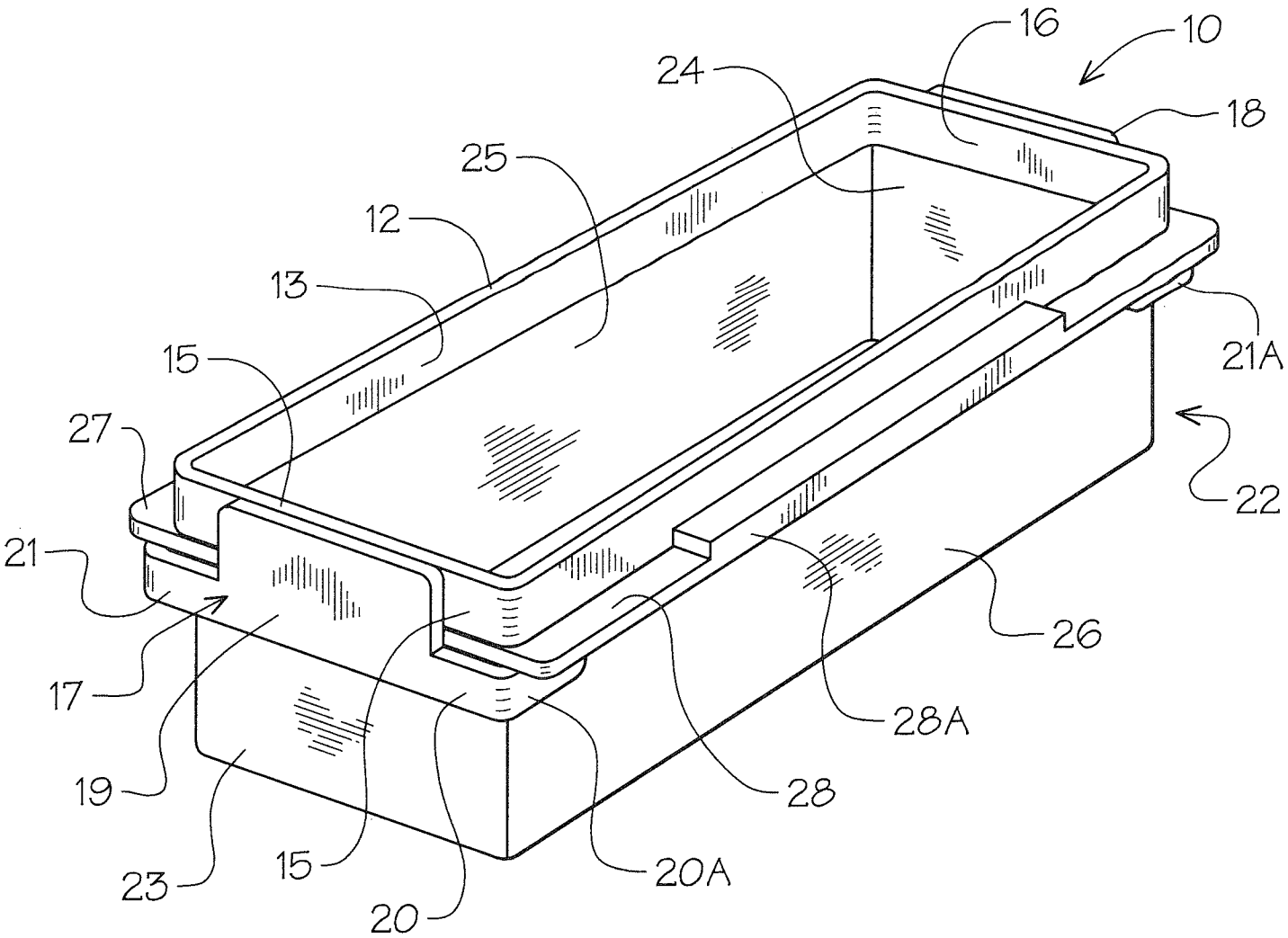
FIG. 1 is a perspective view of the assembled flexible grip mud pan of the invention.
Figure 2:
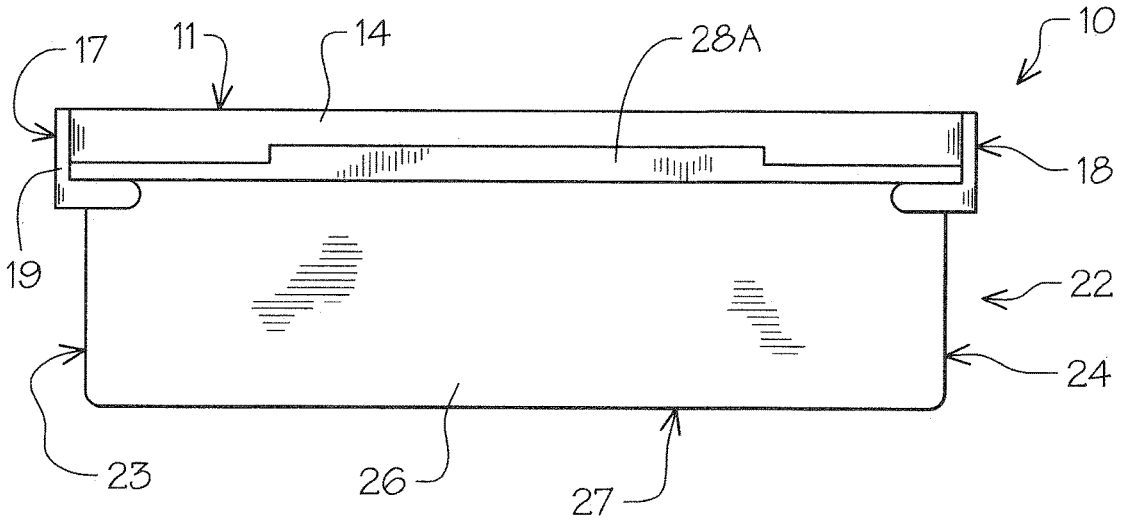
FIG. 2 is a side elevational view thereof.
Figure 3:
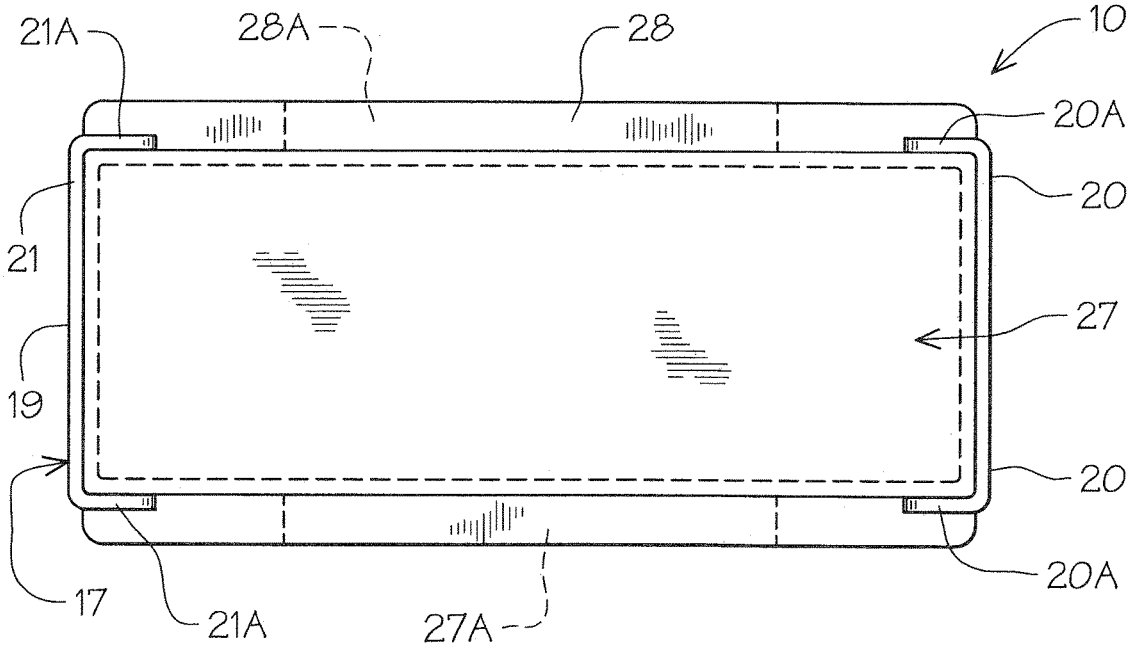
FIG. 3 is a bottom plan view thereof.
Figure 5:
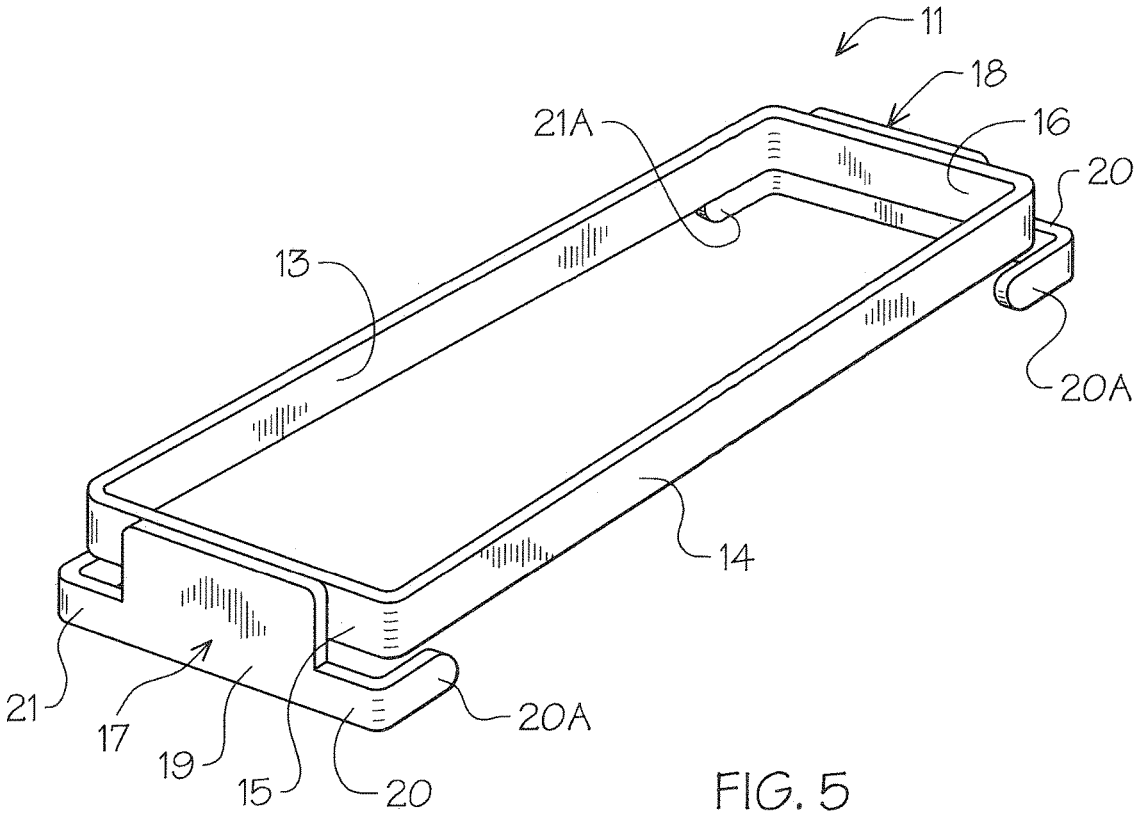
FIG. 5 is a perspective view of the rigid support frame of the invention.
Figure 6:
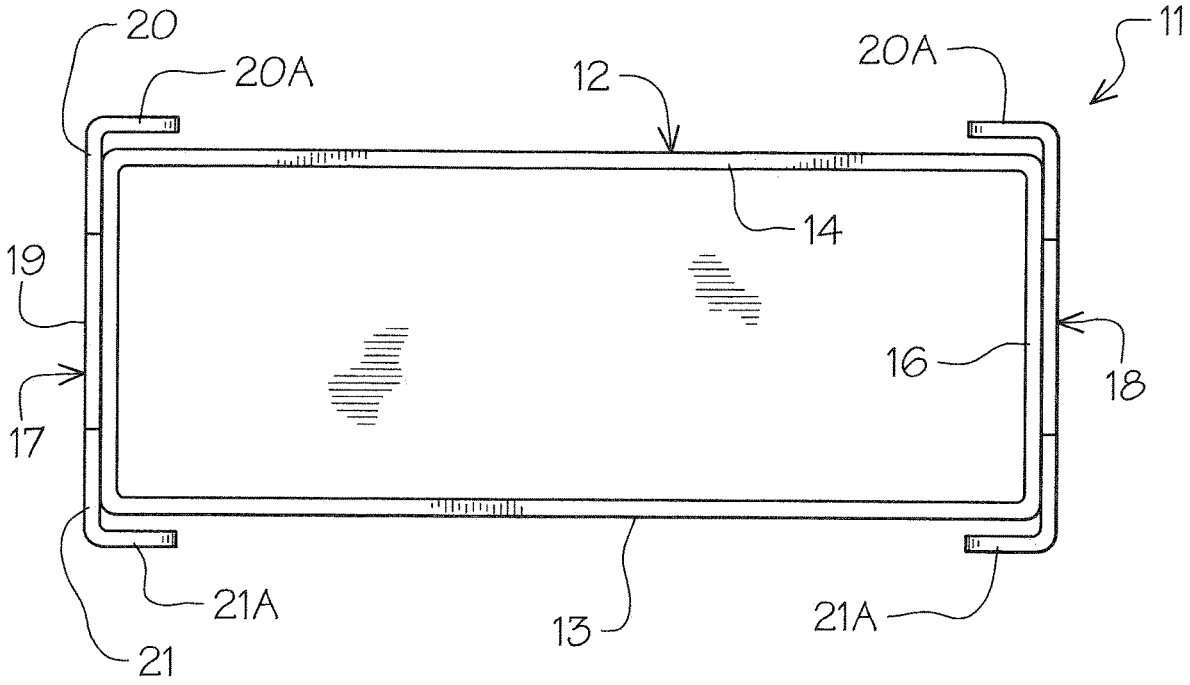
FIG. 6 is a bottom plan view thereof.
Figure 7:
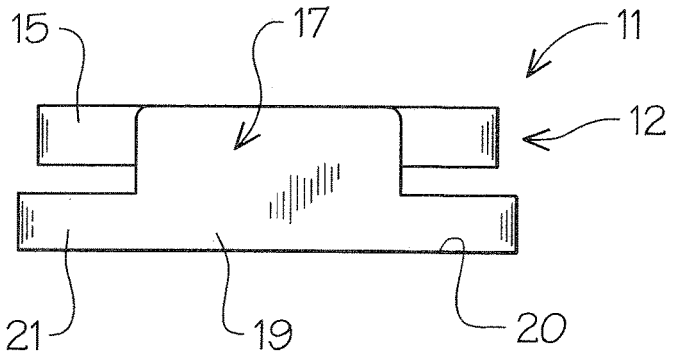
FIG. 7 is an end elevational view thereof.
Figure 8:
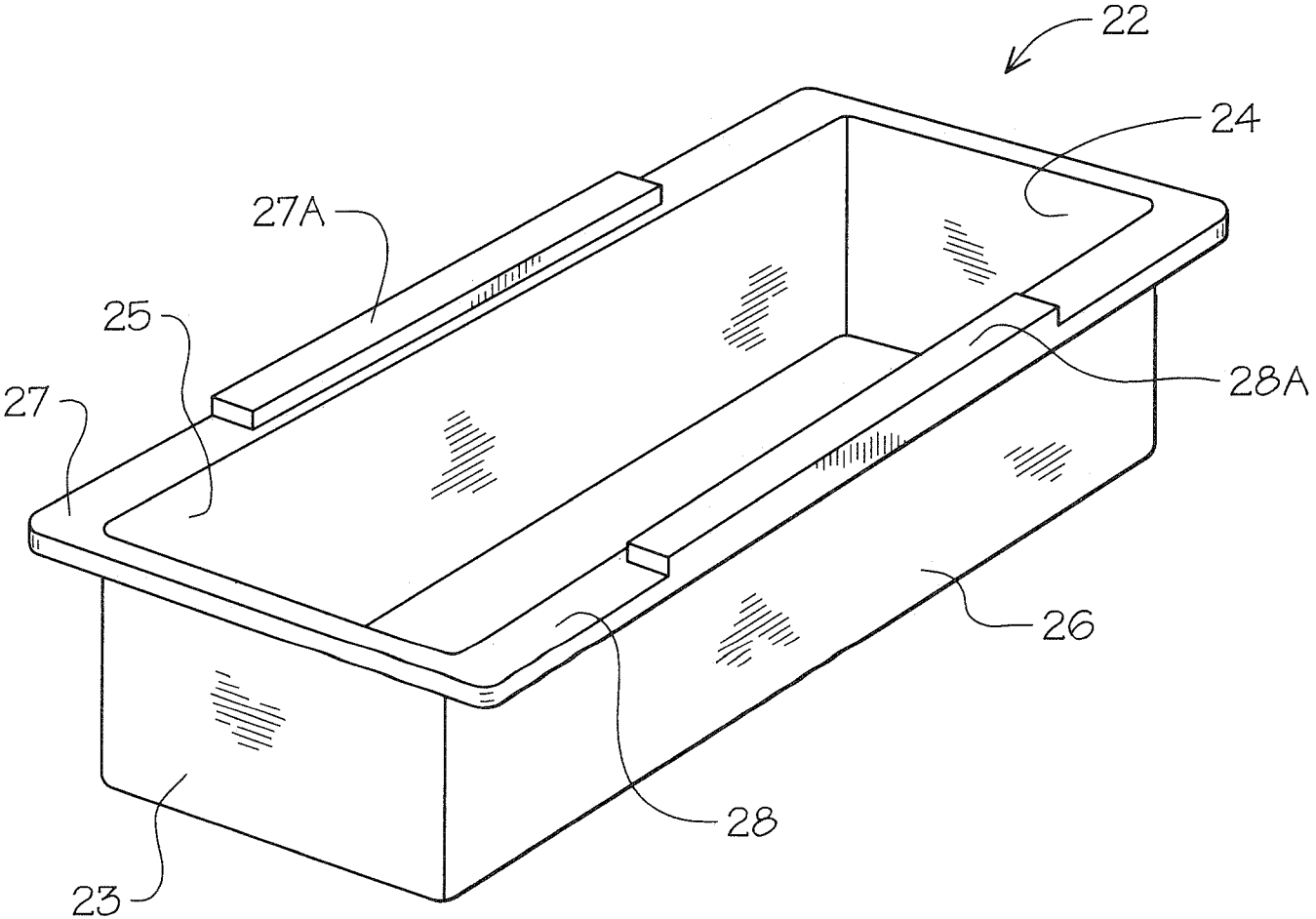
FIG. 8 is a perspective view of the flexible trough insert of the invention.

Referring now to FIGS. 1, 2 and 3 of the drawings, a drywall mud pan assembly 10 of the invention can be seen having a rectangular configuration with a rigid support frame 11 defined by a rectangular support band 12 defining oppositely disposed spaced parallel side support engagement bands 13 and 14 with interconnecting ends 15 and 16 as best seen in FIG. 5 of the drawings. Frame end extension fittings 17 and 18 are secured to the respective ends 15 and 16 each having an integral depending flange fitting 19 with oppositely disposed integral extending end tabs 20 and 21, each with a right-angled respective end portion 20A and 21A in vertically spaced offset parallel relation to respective upstanding band edges 13 and 14 as best seen in FIGS. 5, 6 and 7 of the drawings. It will be evident that this tab orientation will allow for interlocking insertion of a resilient flexible trough insert 22 seen in FIG. 8 of the drawings. The trough insert 22 is of a one-piece molded construction of flexible synthetic resin material having spaced oppositely disposed vertical end walls 23 and 24 with interconnecting elongated sidewalls 25 and 26. An interconnecting flat bottom 27 defines a material containment configuration.

Elongated frame engagement flanges 27 and 28 extend at right angles from the respective upper free edges of the sidewalls 25 and 26, each with a centrally elongated raised offset retainment registration portion 27A and 28A.

Figure 4:
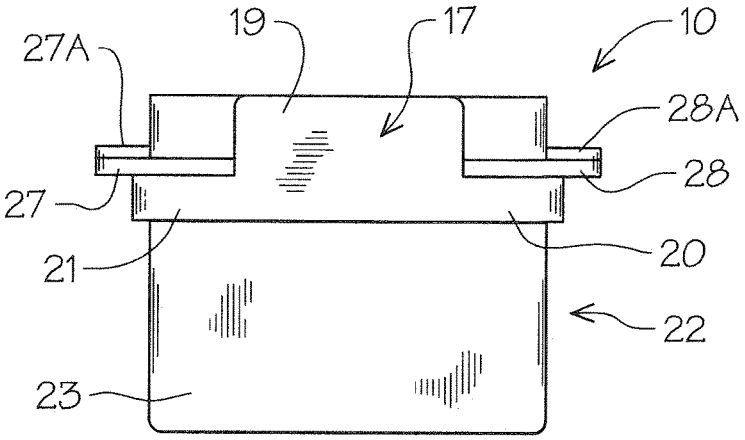
FIG. 4 is an end elevational view thereof.

Referring now to FIGS. 1, 2, and 4 of the drawings, the resilient trough insert 22 is engaged partially in the hereinbefore described rigid support frame 11 with the trough's respective flanges 27 and 28 inserted between the bottoms of the engagement bands interconnecting ends 15 and 16 and the upper surfaces of the corresponding space offset integral extending end tabs 20 and 21 on each of the depending attached flanges 19, best seen in FIGS. 1, 2 and 4 of the drawings.

The elongated raised transversely offset retainment registration portions 27A and 28A will therefore be engaged along the respective outer surface portions of the side support engagement bands assuring that the flexible insert sidewalls 23 and 24 shape retainment thereto.

It will be noted that the insert 22's orientation within and abutting the rigid support frame 11 thereby defines a smooth interior surface transition between the flexible sides and end walls of the insert 22 and the support bands 13 and 14 and ends 15 and 16 as illustrated in FIG. 1 of the drawings.

Referring now to FIGS. 9-12 of the drawings, an alternate form of the invention 30 can be seen wherein a rigid one piece molded synthetic resin drywall mud tray support frame 31 has spaced parallel side bands 32 and 33 and interconnecting ends 34 and 35. Each of the respective ends 34 and 35 have an integral depending flange portion 36 with oppositely disposed outwardly extending contoured tabs 37 and 38 with respective right angled end portions 37A and 38A.

Figure 10:
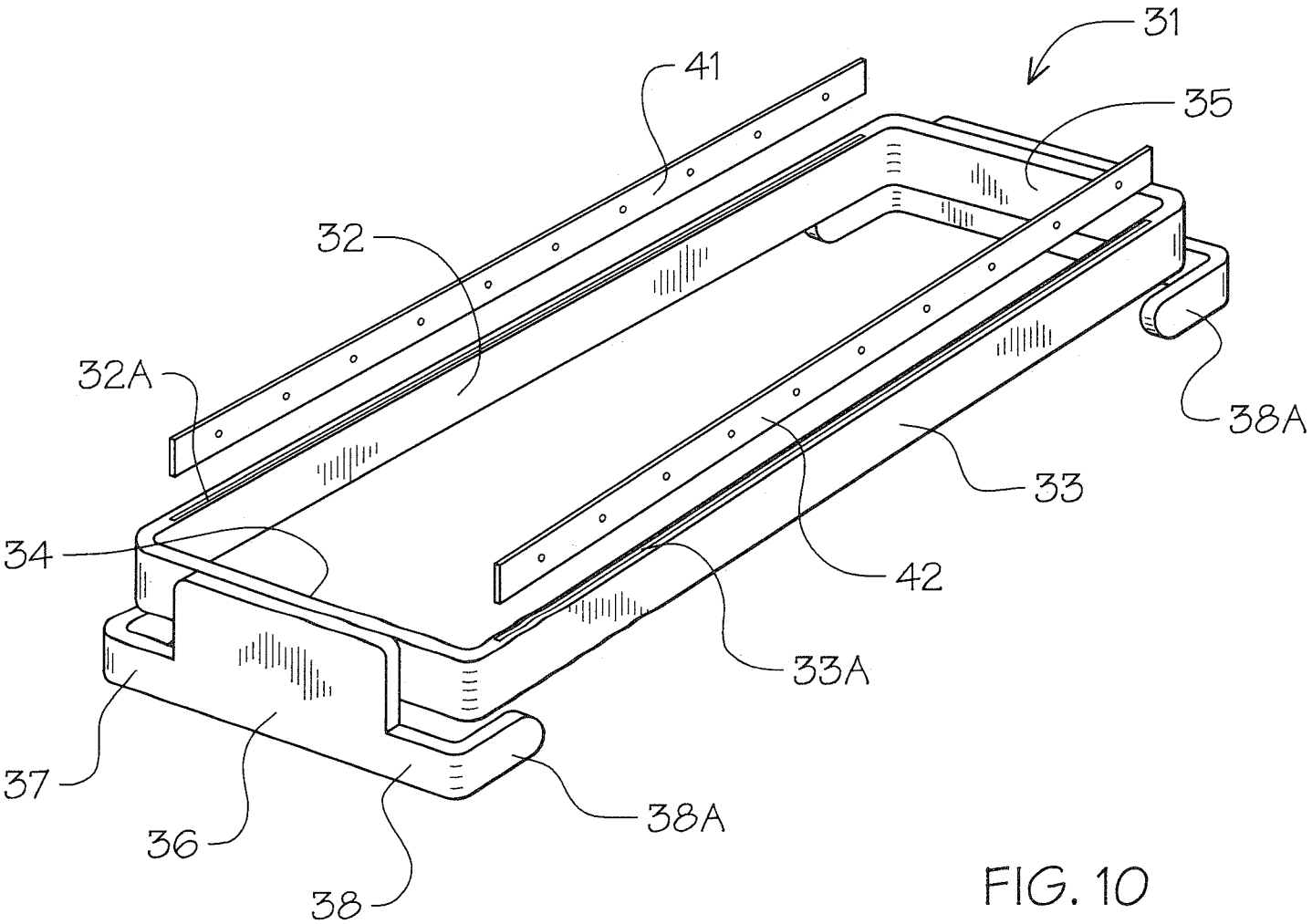
FIG. 10 is an exploded perspective view of the rigid support frame of the alternate form of the invention.

It will be evident that the alternate one-piece molded support frame 30 will therefore function the same as the hereinbefore described preferred form of the invention drywall mud pan 10. The key difference is that a pair of metal edge blade inserts 41 and 42 are required and are registerably received within corresponding receiving slots 32A and 33A in their respective upper edges of the side bars 32 and 33 as best seen in FIGS. 10, 11 and 12 of the drawings.

Figure 9:
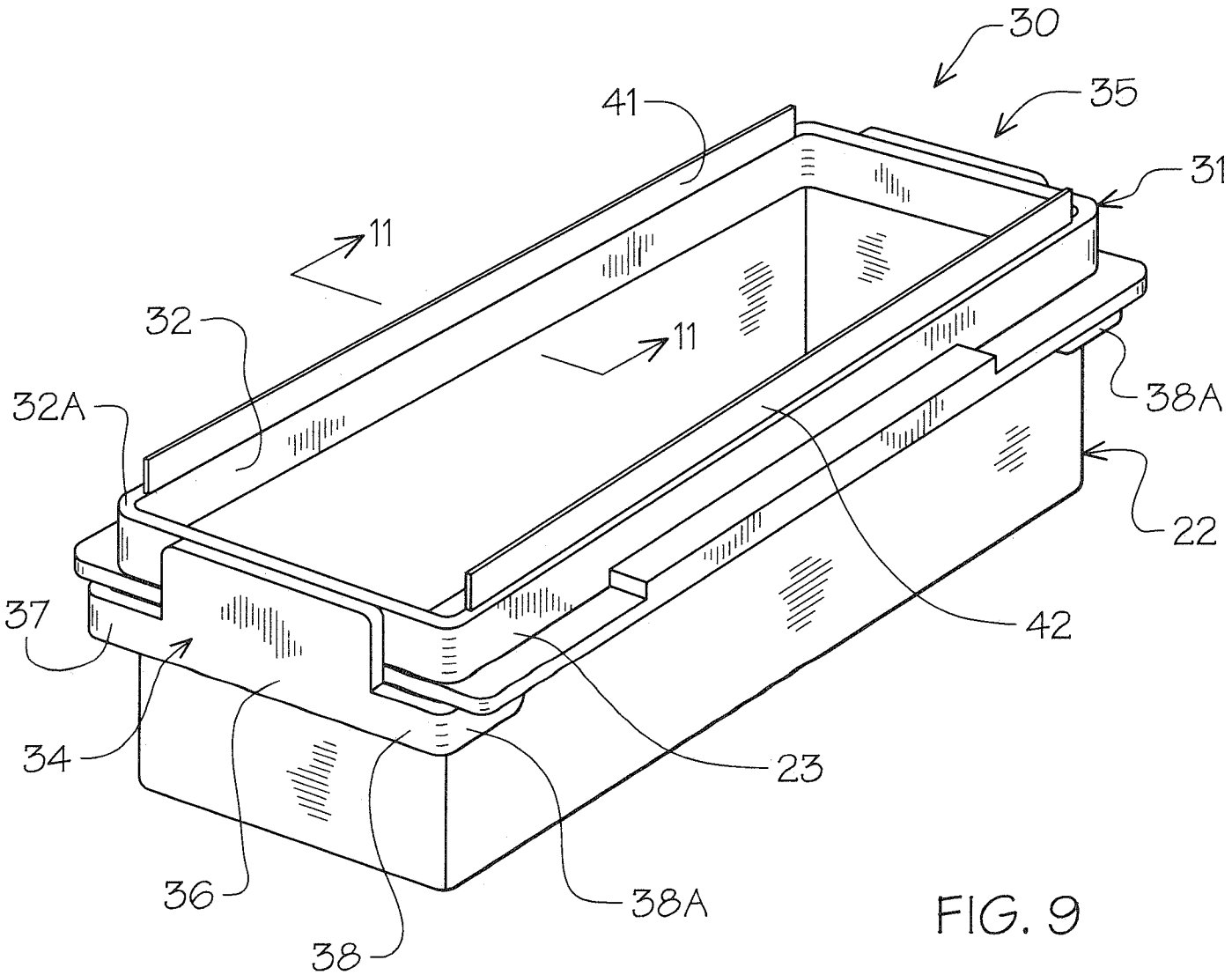
FIG. 9 is a perspective view of an alternate assembly of the invention having side edge inserts.
Figure 11:
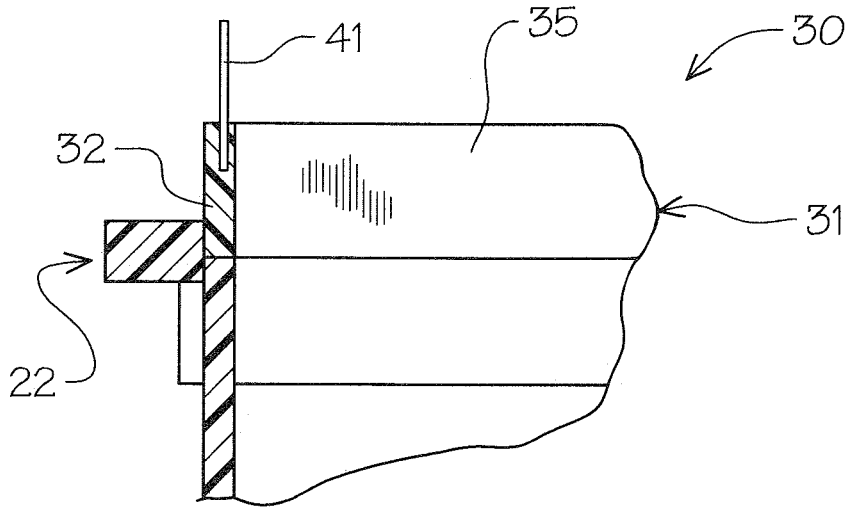
FIG. 11 is an enlarged partial cross section on lines 11-11 of FIG. 9.
Figure 12:
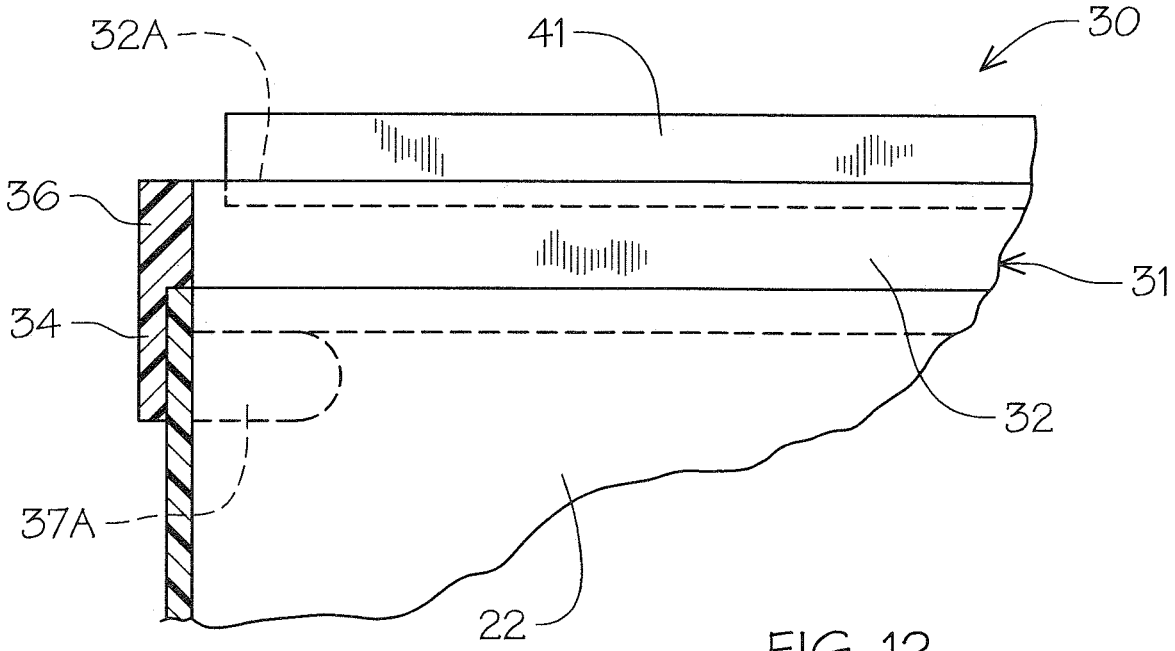
FIG. 12 is an enlarged partial cross-sectional view of the side edge blade insert positioning.
Figure 13:
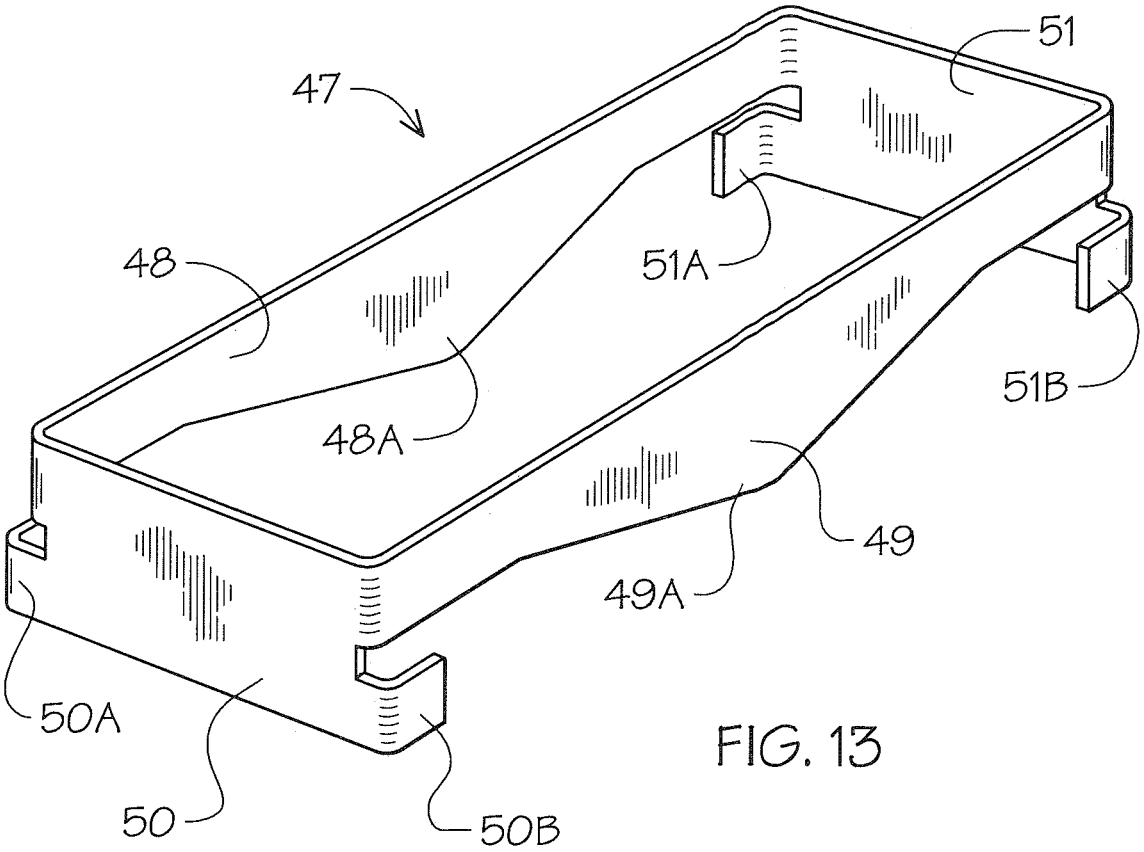
FIG. 13 is a perspective view of an alternate rigid support frame of the invention.
Figure 14:
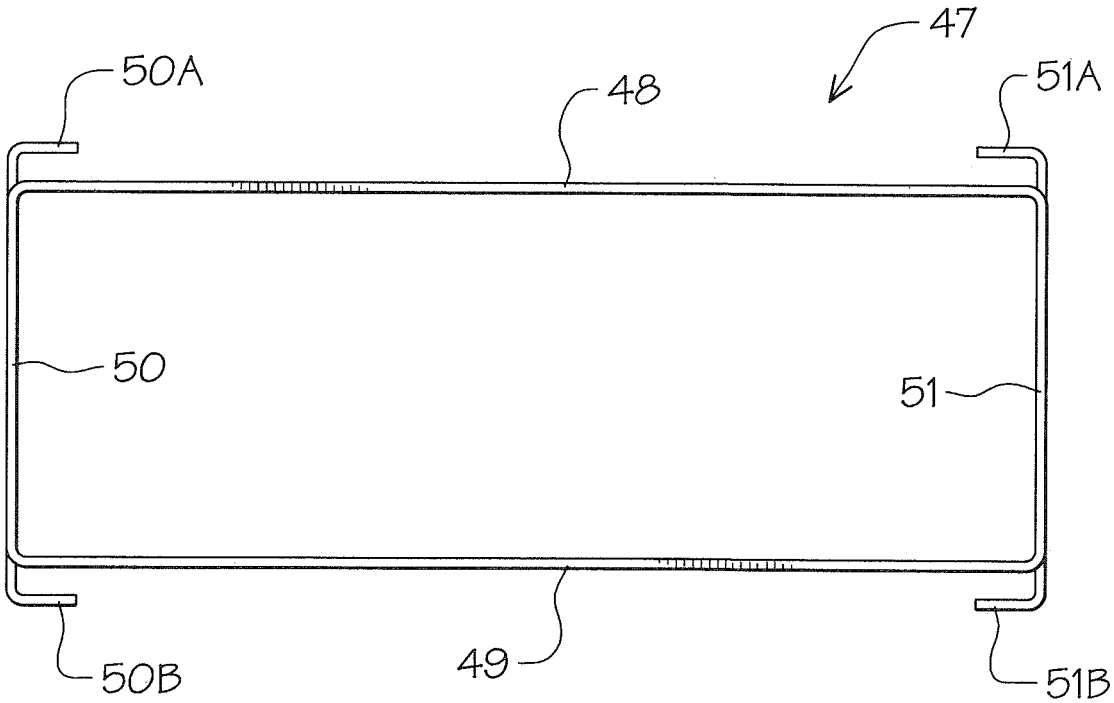
FIG. 14 is a top plan view thereof.
Figure 15:
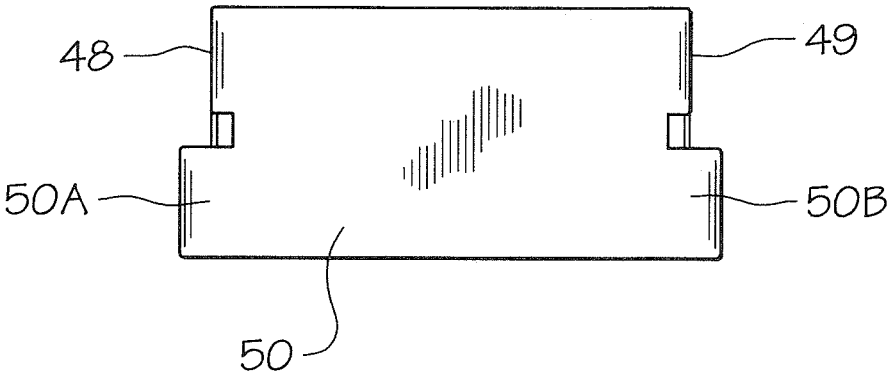
FIG. 15 is an end elevational view thereof.
Figure 16:
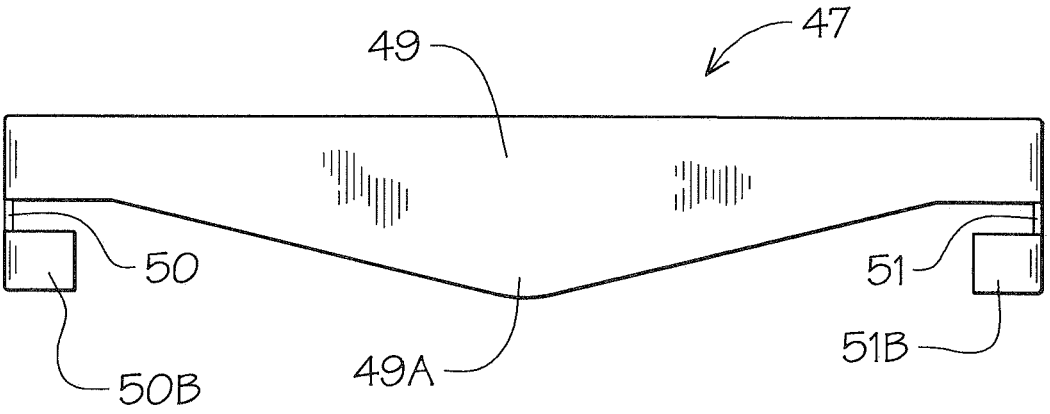
FIG. 16 is a side elevational view thereof.

The resilient trough insert 22 of the primary form can be used in the alternate mud tray 30 given the interlocking orientation of the respective extending tabs 37 and 38 as to the spaced aligned side bands 32 and 33 as best seen in FIGS. 9, 11 and 12 of the drawings is the same as hereinbefore described.

Referring now to FIGS. 13-18 of the drawings, an alternate hybrid drywall mud pan assembly 45 can be seen having a resilient flexible mud receiving body member 46 and an insertable rigid support frame 47. The alternate rigid support frame 47, best seen in FIGS. 13-16 of the drawings has oppositely disposed spaced parallel side wall support frames 48 and 49, each with a tapered depending central portion 48A and 49A and interconnecting continuous respective ends 50 and 51. Each of the ends have spaced oppositely disposed pairs of locking tabs 50A and 50B and 51A and 51B.

Figure 17:
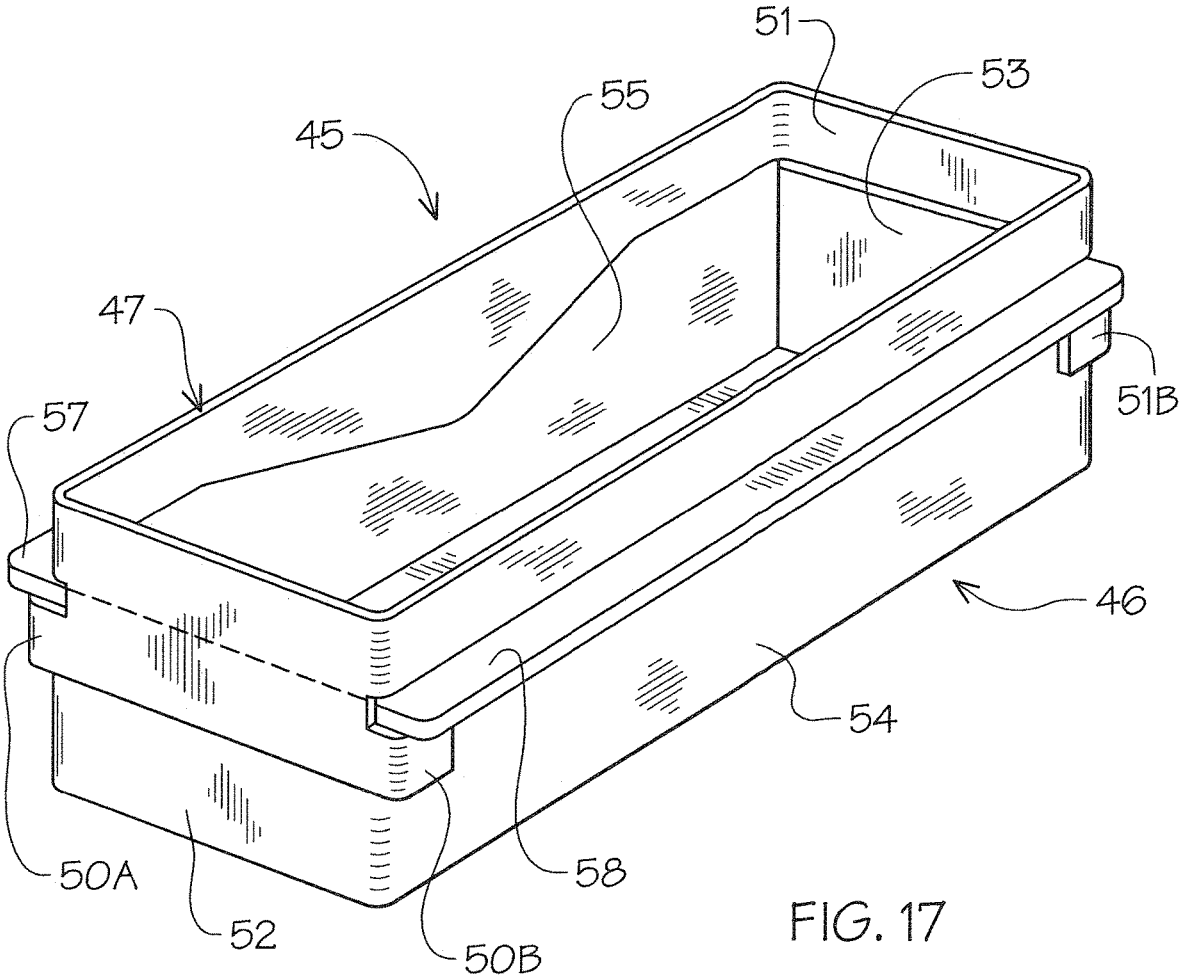
FIG. 17 is a perspective view of the flexible trough insert of the alternate mud pan assembly.
Figure 18:
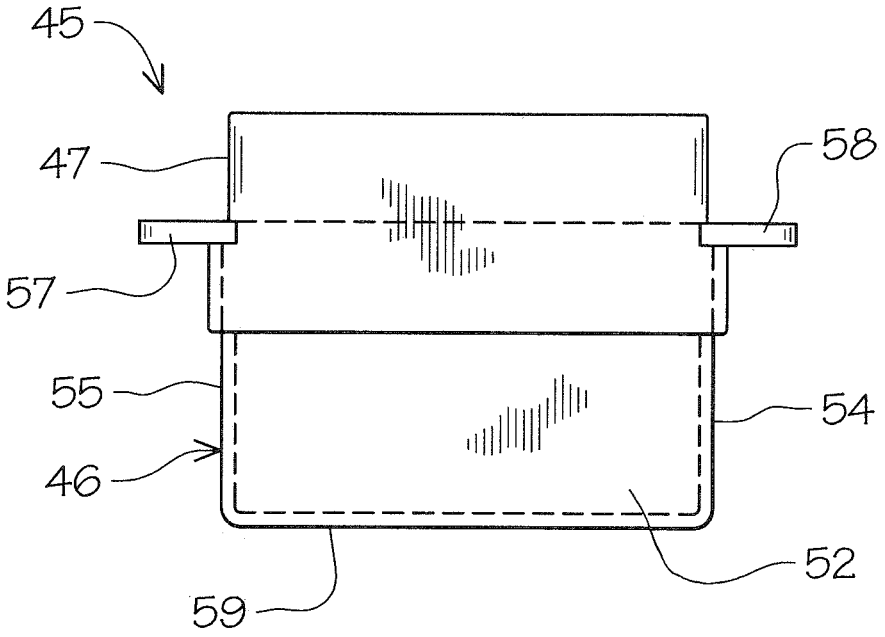
FIG. 18 is an end elevational view of the flexible mud pan assembly.

The tab pairs extend both transversely and longitudinally in a L-shaped configuration forming a locking retainment for the flexible mud receiving body member 46, best seen in FIGS. 17 and 18 of the drawings. The flexible body member 46 is a one-piece molded flexible synthetic resin material based with a spaced oppositely disposed vertical integral end walls 52 and 53 and interconnecting elongated sidewalls 54 and 55.

An interconnecting flat bottom 59 forms the material retainment space there within. A pair of oppositely disposed elongated flexible engagement flanges 57 and 58 extend at right angles from the respective free edges of the sidewalls 54 and 55.

Referring now to FIGS. 17 and 18 of the drawings, the resilient mud receiving body member 46 has the support frame 47 inserted there within by deflecting the respective engagement flanges 57 and 58 between the correspondingly depending and extending tab pairs 50A and 50B and 51A and 51B with respective ends extending over the corresponding end walls 52 and 53 of the body member 46. The respective sidewall support frames 48 and 49 are registerably positioned within and extend too there above.

The corresponding sidewall support frames 48 and 49 depending portions 48A and 49A are within the flexible body member 46 abutting the inner respective sidewalls 54 and 55 as best seen in FIG. 17 of the drawings.

This insert orientation therefore provides the resilient body member 46 and upstanding perimeter rigid edge criteria to the combination hybrid mud pan for use and will be understood by those skilled in the art.

It will thus be seen that a new and novel hybrid drywall mud retainment and dispensing pan has been illustrated and described and it will be apparent to those skilled in the art that various changes and modifications may be made thereto without departing from the spirit of the invention. Therefore, I claim:

1. A container assembly for holding a volume of settleable materials comprising, a rigid support frame insert having spaced, parallel sidewalls with continuous depending, integrated ends, oppositely disposed pairs of spaced, independent, L-shaped tab portions extending transversely and longitudinally from said continuous depending, integrated ends in spaced vertical and horizontal relation to said respective sidewalls, a longitudinally tapered, lower edge depending, center portion on each of said sidewalls in spaced relation to said respective continuous depending, integrated ends, a resilient, deformable trough registerable between said tab portions on said continuous depending, integrated ends and said longitudinally tapered, lower edge depending, center portions of said rigid support frame, said deformable trough having interconnecting, parallel sidewalls and oppositely disposed end walls with an integral bottom and a pair of spaced, parallel flanges extending at right angles from said respective interconnecting, parallel sidewalls, portions of said frame insert sidewalls and said continuous depending, integrated ends extending above and beyond said deformable trough, defining a continuous, ridge tool engagement edge there about.

2. The container assembly set forth in claim 1 wherein said L-shaped tab portions are registerably engaged on portions of the trough sidewalls adjacent said respective oppositely disposed end walls locking said support frame insert onto said resilient, deformable trough.

3. The container assembly set forth in claim 1 wherein each longitudinally tapered, lower edge depending, center portion of said frame insert sidewalls are registerably engaged against inner effacing portions of said parallel sidewalls of said deformable trough.

4. The container assembly set forth in claim 1 wherein said deformable trough spaced parallel flanges extend over said respective L-shaped tab portions and beyond said respective sidewalls of said rigid support frame insert at right angles thereto.

* * * * *